United States Patent [19]

Clausen

[11] 4,337,636

[45] Jul. 6, 1982

[54] VEHICLE SECURING DEVICE FOR FRAME STRAIGHTENING AND REPAIRING APPARATUS

[76] Inventor: Allan H. Clausen, 24406 Alliene, Lomita, Calif. 90717

[21] Appl. No.: 148,726

[22] Filed: May 12, 1980

[51] Int. Cl.[3] ..... B21D 1/12

[52] U.S. Cl. ..... 72/457; 72/705

[58] Field of Search ..... 72/457, 705; 410/8, 410/11, 104, 105, 116; 269/99–101; 248/316 R, 316 B, 316 E

[56] References Cited

U.S. PATENT DOCUMENTS

| | | | |
|---|---|---|---|
| 372,714 | 11/1887 | Shaw | 269/101 X |
| 2,463,966 | 3/1949 | Hauschild | 72/705 X |
| 3,091,278 | 5/1963 | Padgett | 72/705 X |
| 3,351,356 | 11/1967 | Clark et al. | 410/116 X |
| 3,630,066 | 12/1971 | Chisum | 72/705 X |
| 3,818,750 | 6/1974 | Ballweber | 72/705 X |
| 3,888,100 | 6/1975 | Chisum | 72/705 X |
| 3,921,433 | 11/1975 | Whitney | 72/705 X |
| 4,138,876 | 2/1979 | Chisum | 72/705 X |
| 4,138,877 | 2/1979 | Specktor | 72/705 X |
| 4,151,737 | 5/1979 | Specktor | 72/705 X |

*Primary Examiner*—Lowell A. Larson
*Attorney, Agent, or Firm*—Lyon & Lyon

[57] ABSTRACT

A device is provided for removably and adjustably securing a vehicle to a slotted support surface of a vehicle frame straightening apparatus. The device can comprise base plate having elongated rotatable restraining members for adjustably securing the base plate to the support surface along a first axis and frame attachment means such as a clamp that is adjustable along a second perpendicular axis. The clamp is used to grip a portion of the vehicle frame.

10 Claims, 13 Drawing Figures

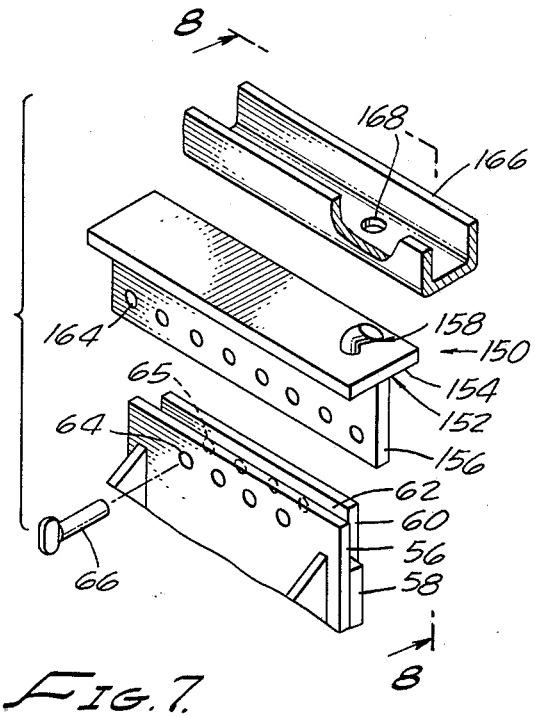
FIG. 7.
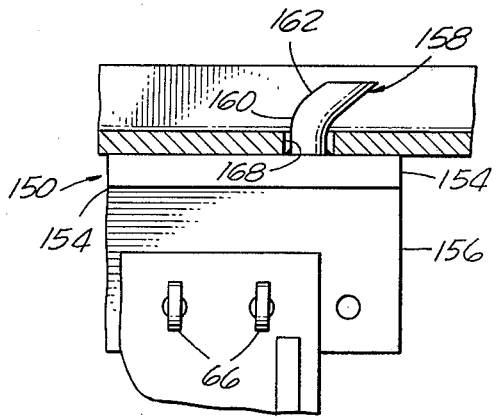
FIG. 8.
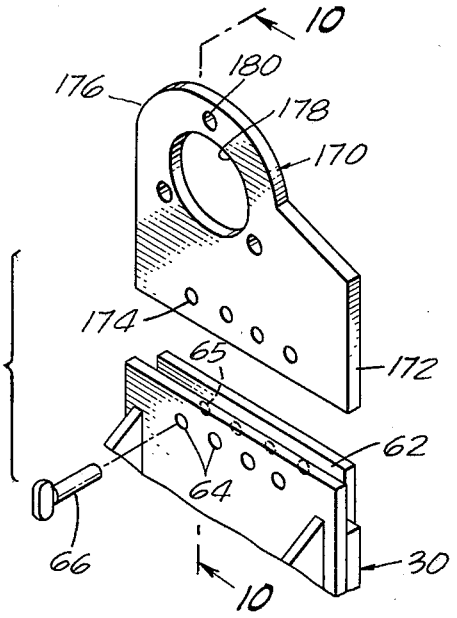
FIG. 9.
FIG. 10.
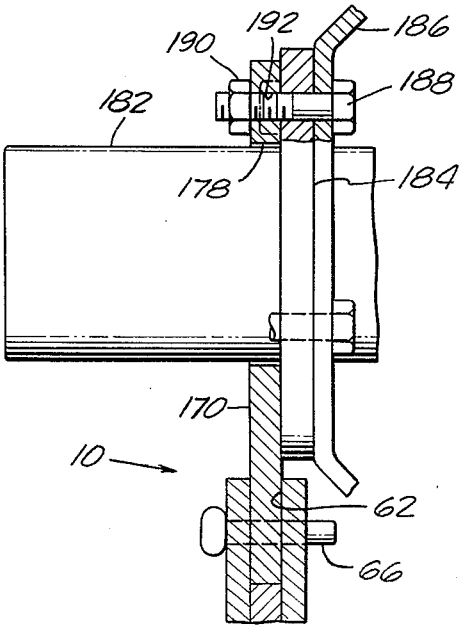

VEHICLE SECURING DEVICE FOR FRAME STRAIGHTENING AND REPAIRING APPARATUS

BACKGROUND OF THE INVENTION

The present invention relates generally to vehicle frame straightening apparatus and more particularly to devices for removably securing vehicles to such apparatus.

Various apparatus are known for straightening and repairing vehicle frames. As described in U.S. Pat. Nos. 3,630,066, 3,888,100 and 4,151,737, such apparatus generally include parallel left and right treadways upon which the vehicle is positioned and suitable means such as pull towers for applying force to the vehicle frame to straighten or adjust the frame.

It is necessary to secure a vehicle to a frame straightening apparatus so that the vehicle remains fixed with respect to the treadways while the frame straightening or adjusting forces are applied to the vehicle frame. It is generally desirable that the securing device be easily adjusted so that vehicles of varying sizes can be readily accommodated. Once the vehicle is secured to the frame straightening apparatus, it is also desirable that the securing device neither interfer with nor make more difficult the operation of the frame straightening apparatus. The frame straightening forces that are applied to a vehicle can be from several directions during the straightening process as would occur, for example, with a vehicle which has sustained both front and rear frame damage. It is thus further desirable that a securing device counteract these variously applied forces without readjustment or repositioning so that the frame straightening can be more efficiently performed.

A securing device is disclosed in U.S. Pat. Nos. 3,630,066 and 3,888,100 to Chisum. The device includes a clamp which can be applied to a pinchweld of a unibody frame. A chain, which is connected at one end to the clamp, is provided at its second end with a hook which engages crossmembers within the treadway. As the frame straightening forces are applied from various directions as would occur, for example, where the forces are first applied to the front of the vehicle and then are applied to the rear of the vehicle, it is necessary to reposition the chain and the hook to provide the correct counterforce to the clamp. This is both time consuming and inconvenient. Furthermore, the chain and the hood require time consuming readjustment when side forces are applied to the vehicle to prevent the vehicle from being pulled from the treadways.

Another securing device is described in the Chisum U.S. Pat. No. 3,888,100. The device includes posts that can be inserted through openings within the treadway and which serve to anchor the chain. A disadvantage of this Chisum device is that adjustment and repositioning are required as the frame straightening forces are applied from various directions.

Another device is disclosed in U.S. Pat. No. 4,151,737 to Specktor and includes a bolster that is inserted through the treadway. The bolster includes a contacting surface and the bolster can be adjusted so that the contacting surface abuts a frame member of the vehicle to be straightened. However, as the direction of the frame straightening pulling force is changed, the bolsters must be removed and repositioned. The contacting surface of the bolsters also does not grip the vehicle frame and thus the frame can slip with respect to the bolsters if the straightening forces are not properly applied. The bolsters can also interfere with the operation of the frame straightening apparatus by, for example, obstructing the movement of the pull towers beneath the treadway.

Yet other devices are disclosed by Specktor in U.S. Pat. No. 4,138,877. These devices include a clamp which can be clamped to the pinchweld of a unibody frame, a fork and an elevated chain hook and shortener. The fork and the elevated chain hook and shortener are retained by means of an attachment member within openings in the surface member of the treadway. The clamp is then positioned to abut the fork or can be attached by means of a chain to the elevated chain hook and shortener. Also, a chain can be attached to the clamp and can be passed around a pulley within the fork so that the fork is used as a down-pull unit.

The clamp in combination with the fork or a chain and the elevated chain hook and shortener has several shortcomings. The devices must be repositioned and adjusted as the frame straightening forces are applied from various directions. Furthermore, the fork, when used as a down-pull unit, does not provide the support required when horizontal frame straightening forces are applied to the vehicle.

Therefore, there is a need for a clamping device that overcomes the limitations described above in that is easily adjusted, it does not interfere with the operation and use of the frame straightening apparatus, and it counters frame straightening forces applied from any angle without requiring adjustment or repositioning of the device.

SUMMARY OF THE INVENTION

The present invention is directed to a clamping device with these features. The device comprises a base plate which is adapted to be removably and adjustably secured to an elongated support surface member of a frame straightening apparatus treadway so that the base plate can be adjusted along a first axis of the support surface member. The device includes gripping means for removably gripping a portion of the vehicle frame and attaching means which attach the gripping means to the base plate so that the gripping means can be adjusted along a second axis of the support surface member. The second axis is substantially perpendicular to the first axis.

The support surface member includes an elongated slot which has an elongate axis that defines the support surface member first axis. The support surface member can include a plurality of such slots arranged transversely or longitudinally to thereby define a plurality of first or slot axes.

To provide the adjustment along a slot axis, the base plate includes two elongated, rotatable restraining members that can be inserted through an elongated slot when the restraining members are in a first position. The restraining members can then be rotated to a second position substantially perpendicular to the elongated slot and can be urged toward the base plate. In this way, the support surface member is secured between the restraining members and the base plate to thereby adjustably secure the device along the slot axis.

Another version of the clamping device can be used with treadways that have rectangular openings through the support surface member. In this version, the clamping device includes two restraining assemblies that each have a stop plate that can be removably retained within two corresponding support surface member openings. The base plate includes two elongated slots through which the restraining assemblies pass to thereby adjustably secure the base plate to the support surface member along the first axis defined by the base plate elongated slots.

In another version, the clamping device can be used with treadways that have circular openings therethrough. In this third version, the clamping device includes two restraint adapters that each have a stop plate. The restraint adapters can be inserted upwardly through the treadway opening until the stop plate abuts the treadway. The base plate includes two elongated slots through which the restraint adapters pass to thereby adjustably secure the base plate to the treadway along a first axis of the treadway defined by the base plate elongated slots.

The gripping means can include a clamp for gripping a portion of the vehicle frame. The attaching means includes a channel for receiving the gripping means and pins for securing the gripping means within the channel to allow adjustment of the gripping means along the second axis, that is, an axis that is perpendicular to the slot axis. By adjusting the gripping means within the channel along this perpendicular axis and by adjusting the device within the elongated slot along the slot axis, the device is thus quickly and easily adjusted to avoid obstructions on the vehicle frame and to accommodate a variety of vehicles. Furthermore, by rigidly securing the vehicle frame with respect to the treadway, frame straightening forces can be applied from various directions throughout the frame straightening process without repositioning the device.

Other versions of the gripping means are provided for vehicles employing conventional frames which can include openings formed therein and for specific vehicle frames which have suitable fastening locations.

Advantages of clamping devices according to the present invention include easy axis adjustment of the device to counter forces applied to the vehicle frame from various directions without readjustment of the device and easy attachment to the vehicle and frame straightening apparatus. Additional advantages are that the frame straightening forces can be more accurately and precisely applied to the vehicle frame and that the device does not interfere with the operation and use of a frame straightening apparatus.

IN THE DRAWINGS

These and other features, aspects and advantages of the present invention will become better understood with reference to the following description, appended claims, and accompanying drawings where:

FIG. 7 shows a perspective view of the frame gripping means of another clamping device according to the present invention.

FIG. 8 shows in partial vertical section the gripping means of FIG. 7 along line 8—8 of FIG. 7.

FIG. 9 is a perspective view of a frame gripping means of another clamping device according to the present invention.

FIG. 10 shows in partial vertical section the gripping means of FIG. 9 along line 10—10 of FIG. 9.

DESCRIPTION

Figure 13:
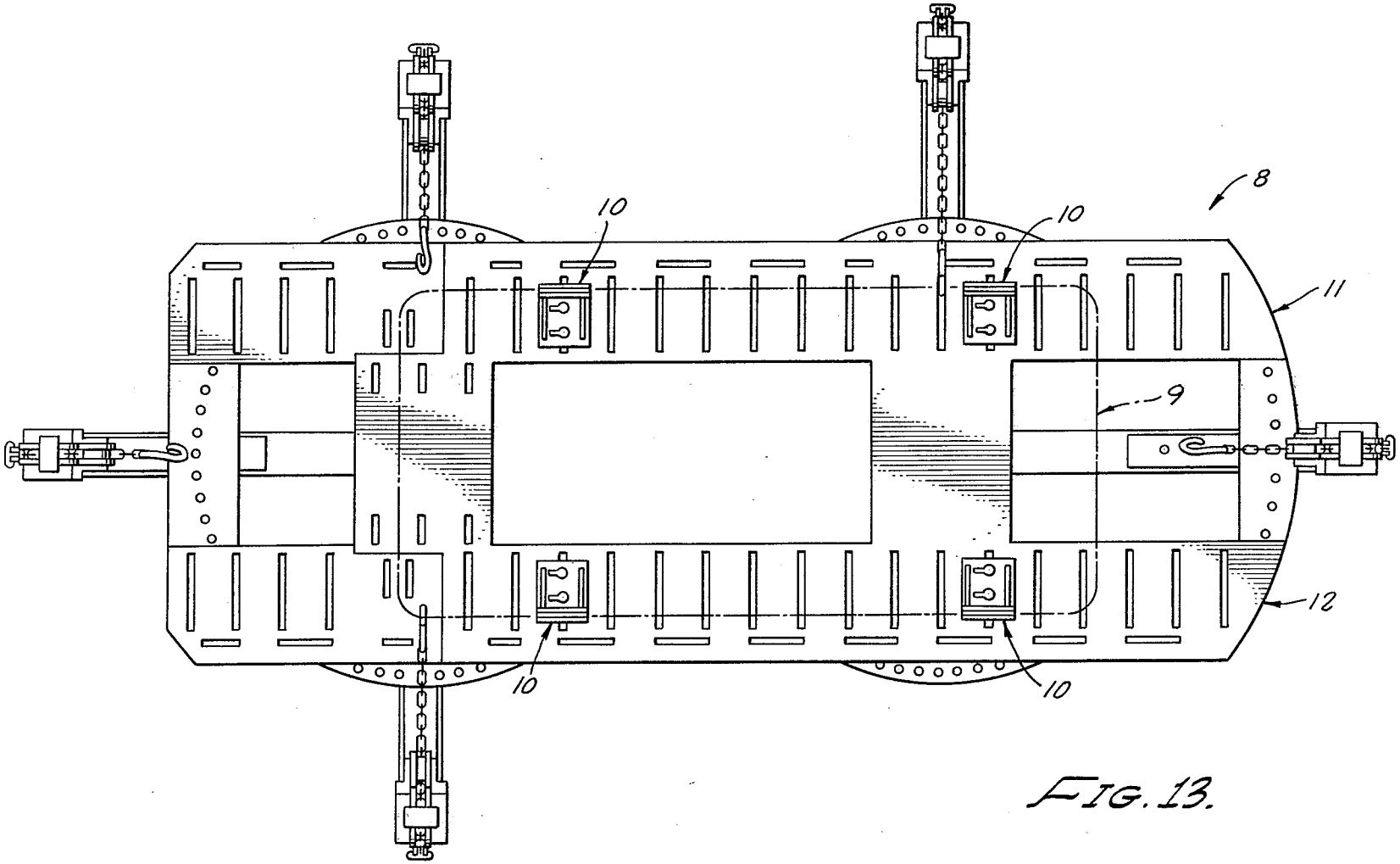
FIG. 13 is a plan view of a frame straightening apparatus employing the first version of a clamping device of the present invention.

As seen in FIG. 13, a frame straightening apparatus 8 generally includes left and right treadways 11 and 12 upon which a vehicle 9 is positioned for frame straightening repair. A plurality of clamping devices 10 according to the present invention are placed on the treadways 11 and 12 to secure the vehicle 9 to the frame straightening apparatus 8.

Figure 1:
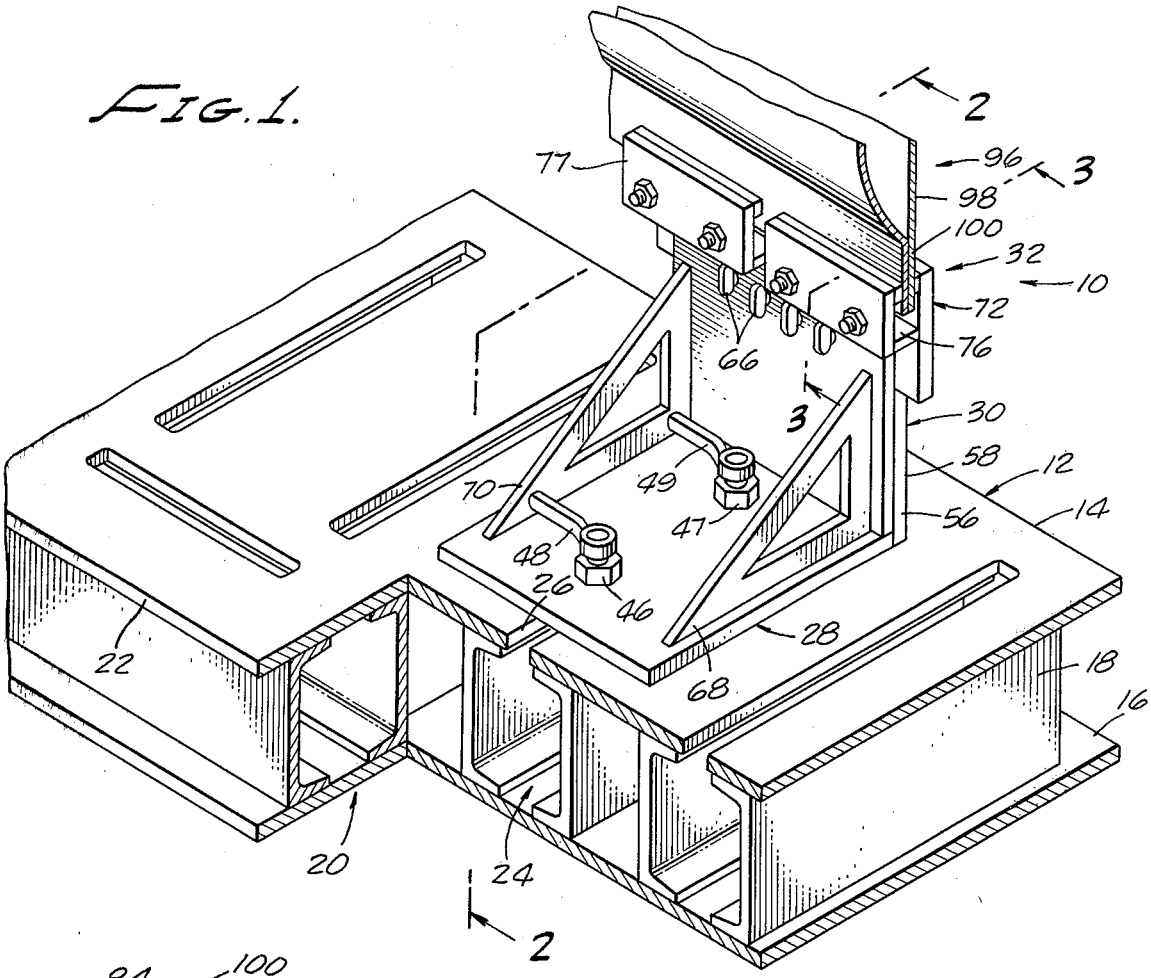
FIG. 1 is a perspective view of a clamping device according to the present invention installed upon a vehicle straightening apparatus treadway.

With reference now to FIG. 1, the clamping device 10 is installed upon the frame straightening apparatus 8 right treadway 12. The right treadway 12 includes an upper support surface member 14, a parallel lower plate member 16, and a plurality of U-channels 18 therebetween. The U-channels 18 are disposed in facing pairs that include a pair 20 near an outer edge 22 of the treadway 12 along an axis generally parallel to the longitudinal axis of the treadway 12 and a plurality of U-channel 18 pairs 24 generally transverse to the treadway 12. A plurality of elongated slots 26 are formed through the support surface member 14 between the U-channel pairs 20 and 24. The left treadway 11 of FIG. 13 is similar to the right treadway 12.

The device 10 generally includes a rectangular base plate 28, an attaching member 30 affixed to the base plate 28, and frame gripping means 32 that can be removably affixed to the attaching member 30. The base plate 10 can be adjustably affixed to the support surface member 14 and the gripping means 32 can be removably affixed to the vehicle 9 to removably secure the vehicle 9 to the frame straightening apparatus 8.

Figure 2:
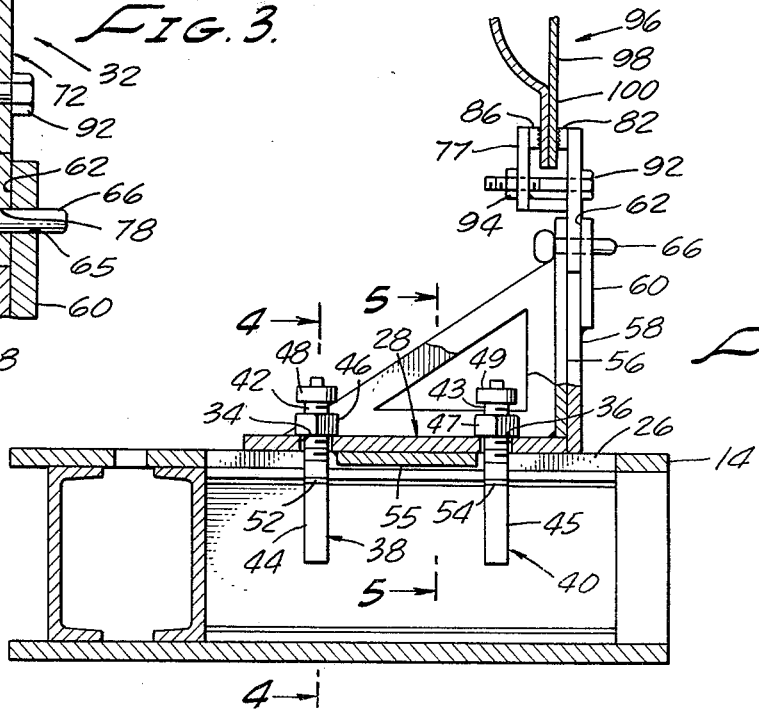
FIG. 2 is a partial vertical section of the device of FIG. 1 taken along line 2—2 of FIG. 1.
Figure 4:
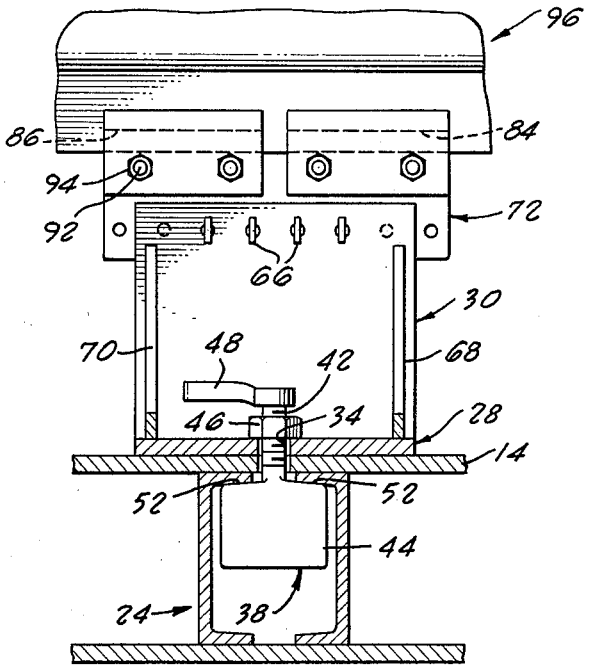
FIG. 4 is a partial vertical cross-section of the device of FIG. 1 taken along line 4—4 of FIG. 2.

As shown in FIGS. 2 and 4, the base plate 28 includes two openings 34 and 36 formed therethrough generally along the central longitudinal axis of the base plate 28. Positioned within the openings 34 and 36 are two restraining assemblies 38 and 40. The assemblies 38 and 40 include threaded shaft portions 41 and 43 within the openings 34 and 36 and generally rectangular restraining members 44 and 45 fixed to the shaft portions 42 and 43 beneath the base plate 28. Two nuts 46 and 47 rotate on the threaded shaft portions 42 and 43 above the base plate 28 and handles 48 and 49 are fixed to the shaft portions 42 and 43 above the nuts 46 and 47. The handles 48 and 49 lie generally within planes defined by the restraining members 44 and 45.

Figure 5:
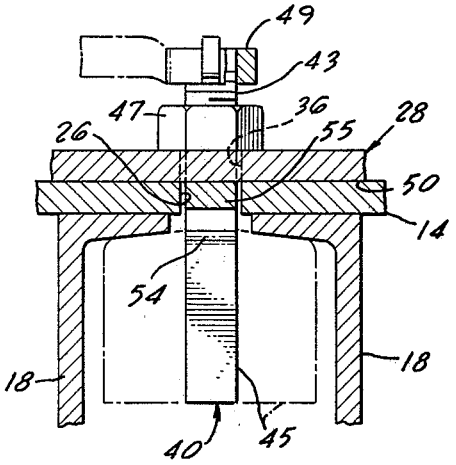
FIG. 5 shows in partial vertical cross-section a portion of the device of FIG. 1 taken along line 5—5 of FIG. 2.

As is best seen in FIG. 5 where the restraining assembly 40 is shown rotated parallel to the elongate axis of the slot 26, the thickness of the restraining member 45 is slightly less than the width of the elongated slot 26 so that the restraining member 45 can be passed through the slot 26. The thickness of the restraining member 44 is equal to the thickness of the restraining member 45. With reference to FIGS. 4 and 5, the nuts 46 and 47 can be rotated upon the shaft portions 42 and 43 to adjust the distance between a lower surface 50 of the base plate 28 and upper surfaces 52 and 54 of the respective restraining members 44 and 45. The handles 48 and 49 rotate the restraining assemblies 38 and 40 coaxially within the openings 34 and 36. With the restraining members 44 and 45 rotated to a position generally perpendicular to the slot 26 elongate axis, the nuts 46 and 47 can be rotated to removably secure the device 10 to the support surface member 14.

The base plate 28 (FIGS. 2 and 5) includes a keel member 55 extending from the lower surface thereof generally between the openings 34 and 36. The width of the keel member 55 is slightly less than the width of the elongated slot 26. The keel member 55 with the restraining assemblies 38 and 40 prevent the base plate 28 from sliding with respect to the support surface member 14 along an axis generally perpendicular to the slot 26 elongate axis. The keel member 55 thereby reduces the sheer forces produced within the threaded shaft portions 42 and 43 between the base plate 28 and the support surface member 14. The keel member 55 also helps to guide the clamping device 10 along the slot 26 elongate axis.

The attaching member 30 (FIGS. 1 and 2) includes an end plate 56, a spacer 58, and an outer channel member 60, all of which are generally perpendicular to the base plate 28. The end plate 56 abuts the upper surface of the base plate 28 and the spacer 58 is fixed to the end plate 56 and to an end surface of the base plate 28. The outer channel member 60 is fixed to the spacer 58 and along with the end plate 56 define sidewalls of a channel 62. The spacer 58 defines the width of the channel 62 and provides a lower surface for the channel 62. The longitudinal axis of the channel 62 is parallel to the plane defined by the base plate 28 and is also perpendicular to an axis defined by the openings 34 and 36 and the restraining assemblies 38 and 40. Formed through the end plate 56 and the outer channel member 60 are a plurality of coaxial openings 64 and 65 (FIG. 6) each of which is adapted to receive a pin 66. The lateral center-to-center distances between the openings 64 and between the openings 65 are substantially equal. Two generally triangular support members 68 and 70 are affixed to the base plate 28 and the end plate 56 to provide support and rigidity to the attaching member 30 with respect to the base plate 28.

Figure 3:
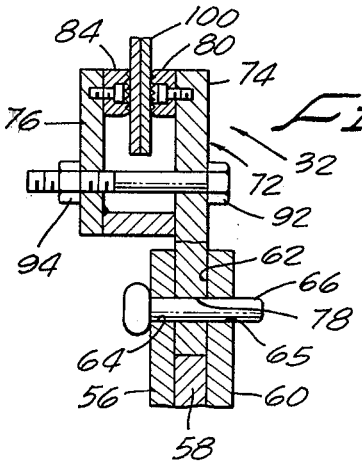
FIG. 3 is a vertical cross-section of the clamp portion of the device of FIG. 1 taken along line 3—3 of FIG. 1.
Figure 6:
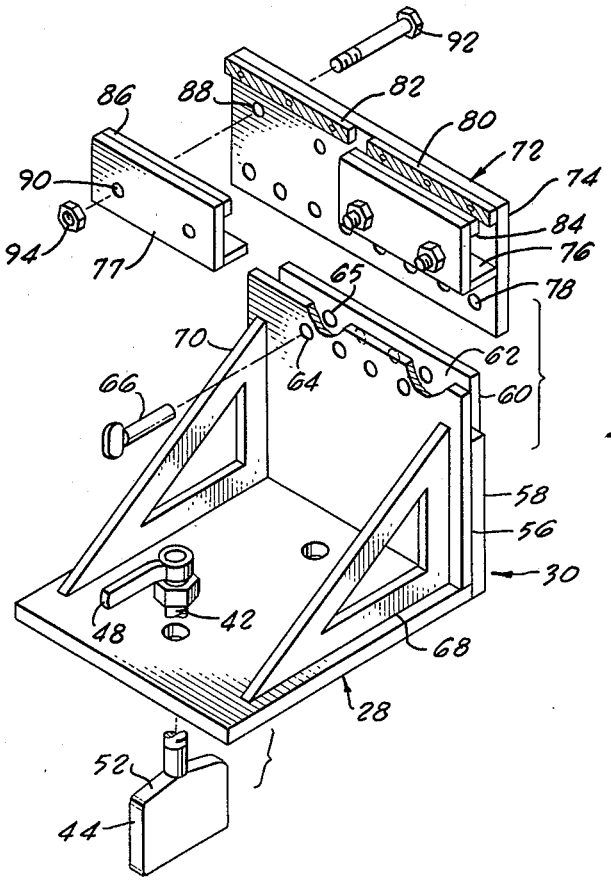
FIG. 6 is a partial exploded perspective view of the device of FIG. 1.

With reference now to FIGS. 3 and 6, the gripping means 32 of the device 10 includes a clamp 72 having a clamp support portion 74 and two generally L-shaped pivot members 76 and 77. A plurality of openings 78 are formed through the clamp support portion 74 near its lower edge and parallel thereto. The lateral center-to-center distances between the openings 78 are substantially equal to the lateral center-to-center distances between the openings 64. The openings 78 are spaced from the lower edge of the clamp support portion 74 such that when the clamp support portion 74 is within the channel 62 so as to abut the spacer 58, the openings 78 can be aligned with the openings 64 and 65 to receive the pins 66. The length of the clamp suport portion 74 is selected such that the number of the openings 78 exceeds the number of the openings 64 or 65, thus allowing the back clamp support portion 74 to be secured in the channel 62 by means of the pins 66 at a plurality of positions. This allows easy and accurate adjustment of the clamp 72 along the longitudinal axis of the channel 62, that is, the axis perpendicular to the slot 26 axis.

Other suitable lateral center-to-center distances between the openings 64 and the clamp support portion openings 78 can be employed. For example, the lateral center-to-center distances between the openings 64 can be approximately one and one-half times the lateral center-to-center distances between the openings 78. Consequently, the clamp 72 can be secured in the channel 62 by means of two of the pins 66 at positions that are more closely spaced than is possible when the lateral center-to-center distances between the openings 64 are equal to the lateral center-to-center distances between the openings 78.

The clamp support portion 74 has two serrated jaws 80 and 82. The pivot members 76 and 77 each include a serrated jaw 84 and 86, respectively, each of which faces a jaw 80 or 82 of the clamp support portion 74. The clamp support portion 74 and the pivot members 76 and 77 also include openings 88 and 90, respectively, which receive bolts 92. Nuts 94 are threaded onto the bolts 92 to thereby urge the pivot members 76 and 77 and the clamp support portion 74 together. A vehicle that has unibody construction includes a frame member 96. As shown in FIGS. 1–3, the frame member 96 can include a rocker panel 98 with a pinchweld 100. The pinchweld 100 can be positioned between the opposing jaw pairs 82, 86 and 80, 84 and is thus firmly grasped therebetween as the bolts 92 and nuts 94 are tightened.

In use, the clamping device 10 as shown in FIGS. 1 and 2 is easily positioned against the treadway 12 by aligning the restraining assemblies 38 and 40 with the central longitudinal axis of the base plate 28 so that the restraining members 44 and 45 can pass through the elongated slot 26. The device 10 can be adjusted along the elongated slot 26 to the desired portions beneath the vehicle frame member 96. The restraining assemblies 38 and 40 are then rotated to a position generally perpendicular to the elongated axis of the slot 26. The nuts 46 and 47 are tightened to thereby urge the upper abutting surfaces 52 and 54 of the restraining members 44 and 45, respectively, (FIGS. 4 and 5) against the upper interior surface of the U-channel pair 24 to secure the device 10 to the right treadway 12.

The vehicle is then lowered to position the pinchweld 100 within the clamp 72. The clamp 72 can be adjusted along the longitudinal axis of the channel 62 to avoid obstructions that can be present on the pinchweld 100. With the pinchweld 100 positioned between the clamp support portion 74 and the pivot members 76 and 77, the pins 66 are installed through the openings 64 and 65 of the attaching member 30 and the corresponding openings 78 within the clamp support portion 74, as shown in FIG. 3. The nuts 94 and bolts 92 are tightened to grip the pinchweld 100 within the clamp 72.

Thus, the device 10 of the present invention is easily adjusted to accept the vehicle frame pinchweld 100 and rigidly secures the vehicle frame member 96 with respect to the treadway 12.

Various other frame gripping means can be retained within the channel 62 in place of the clamp 72. For example, as shown in FIGS. 7–8, a frame support 150 is provided for use with a vehicle frame 166 which includes, for example, an opening 168 formed therethrough. The frame 166 is typically used on vehicles having separate frame and body portions, as contrasted with a unibody vehicle frame 96 of FIG. 1 for which the clamp 72 is preferably employed. The frame support 150 includes a generally T-shaped base 152 comprising a horizontal support member 154 and a vertical member 156 fixed to the lower surface of the support member 154. A projecting member 158 extends upwardly from the upper surface of the support member 154 and has a vertical portion 160 fixed to the support member 154 upper surface. An offset portion 162 of the member 158 is above the vertical portion 160 and angled with respect thereto. The vertical member 156 includes a plurality of openings 164 formed therethrough, these openings 164 being substantially similar to the openings 78 shown in FIG. 6 formed through the clamp support portion 74 of the clamp 72. The vertical member 156 includes a greater number of openings 164 than the number of the openings 64 or 65. This allows the frame support 150 to be secured within the channel 62 by the pins 66 in a plurality of adjustable positions.

In use, the base plate 28 and the attaching member 30 of the clamping device 10 shown in FIG. 1 are positioned on the treadway 12 as previously described. The frame support 150 is secured within the channel 62 beneath the frame opening 168 by the pins 66. As shown in FIG. 8, the vehicle is then lowered into position over the projecting member 158 such that the frame 166 rests upon the support 154. The frame 166 is moved horizontally with respect to the support member 154 as the frame 166 is lowered along the offset portion 162 of the projecting member 158. With the vehicle in place, the vertical portion 160 of the projecting member 158 substantially prevents generally horizontal movement of the frame 166 and the offset portion substantially reduces vertical movement of the frame 160 with respect to the frame support 150. In this way the projecting member 158 substantially rigidly supports the frame 166 for frame straightening forces which may be applied to the vehicle from various angles.

Another frame gripping means for use in the channel 62 includes an adapter member 170 shown in FIGS. 9 and 10 having a lower portion 172 adapted to be received by the channel 62 of the attaching member 30. The lower portion 172 includes a plurality of openings 174. The openings 174 are equal in number to the openings 64 or 65, although a larger number of openings 174 can be included as previously described with respect to the frame support 150 and the clamp 72.

The adapter member 170 further includes an upper portion 176 that has a large central opening 178 and a plurality of smaller radially positioned openings 180. The large central opening 178 and and the smaller openings 180 are adapted to receive specific portions of a vehicle frame. In an exemplary embodiment of FIG. 10, the vehicle frame can include a tortion tube 182 which is secured to a clamp 184, which is in turn affixed to a vehicle frame portion 186 by means of a plurality of threaded fasteners such as the bolts 188 and nuts 190. The large central opening 178 and the smaller openings 180 of the adapter member 170 are adapted to receive the tortion tube 182 and the bolts 188, respectively.

The adapter member 170 when in use is removably fixed within the channel 62 by the pins 66. The nuts 190 are removed from the bolts 188 and the base plate 28 and the attaching member 30 of the clamping device 10 shown in FIG. 1 are then secured to the treadway 12 as previously described by means of the restraining assemblies 38 and 40 such that the adapter member 170 is positioned against the clamp 184. The vehicle tortion tube 182 projects through the large central opening 178 and the bolts 188 project through the smaller openings 180. The nuts 190 are then reinstalled upon the bolts 188, thus rigidly securing the adapter member 170 to the vehicle frame 186 and consequently securing the vehicle frame 186 to the treadway 112. A gripping means such as the adapter member 170 can be useful, for example, when it is desired to precisely position a specific portion of the vehicle frame 186 such as the tortion tube 182 with respect to the treadway 12. The frame straightening forces can then be more precisely applied to the vehicle frame.

Figure 11:
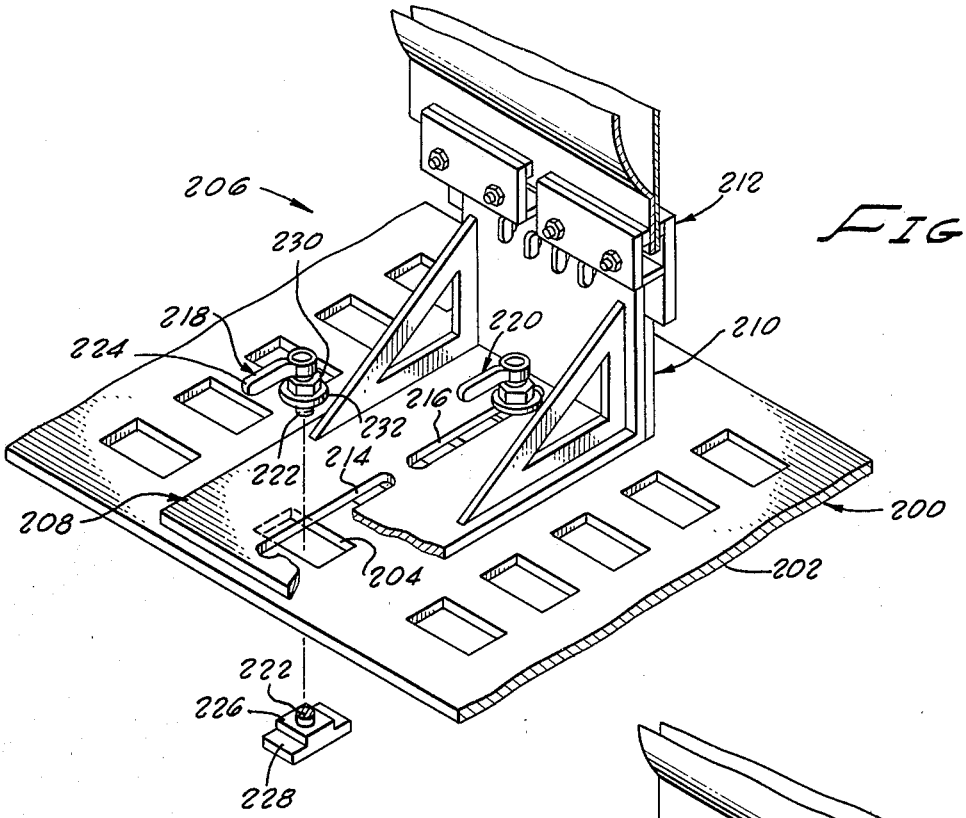
FIG. 11 shows a partially exploded perspective view of another version of a clamping device according to the present invention.

A clamping device of the present invention can be adapted for use with treadways that include rectangular or round openings rather than the slotted openings as was described above. For example, as seen in FIG. 11, the treadway 200 can include a support surface member 202 which in turn includes a plurality of generally rectangular openings 204. The treadway 200 can also include a suitable lower plate member (not shown) and support members (not shown) between the support surface member 202 and the lower plate member as described previously with reference to FIG. 1.

A clamping device 206 according to the present invention for use with the treadway 200 generally includes an elongated rectangular base plate 208, an attaching member 210 affixed to the base plate 208, and frame gripping means 212 that can be removably affixed to the attaching member 210. The attaching member 210 and the frame gripping means 212 can be the same as the attaching member 30 and the frame gripping means 32 described above with reference to FIGS. 1–6 or the various alternative frame gripping means described above as seen in FIGS. 7–10.

The base plate 208 includes two elongated slots 214 and 216 therethrough. The elongate axes of the slots 214 and 216 are colinear. Positioned within the elongated slots 214 and 216 are two restraining assemblies 218 and 220. The elongated slots 214 and 216 can be joined to form a single elongated slot so that the restraining assemblies 218 and 220 can have a greater adjustment range. The restraining assembly 218 includes a threaded shaft portion 222 that is positioned within the slot 214. Fixed to an upper end of the shaft portion 222 is a handle 224. Fixed to a lower end of the handle 224 below the base plate 208 is a generally horizontal support member 226. Fixed to a lower surface of the support member 226 is a horizontal rectangular stop plate 228. The length and width of the stop plate 228 are less than the lengths and widths, respectively, of the rectangular openings 204. Hence, the stop plate 228 can be inserted through one of the rectangular openings 224 when the length of the stop plate 228 is aligned to be generally parallel to the length of the respective rectangular opening 204. The handle 204 is fixed to the shaft portion 222 to be generally parallel to the length or longitudinal axis of the stop plate 228. The diagonal distance between opposite corners of the support member 226 is less than the width of the rectangular openings 204 so that the support member 226 can be rotated freely in a horizontal plane within one of the rectangular openings 204.

A nut 230 is located on the shaft portion 222 between the handle 218 and the base plate 208. A washer 232 is retained by the shaft portion 222 between the nut 230 and the base plate 208.

The restraining assembly 220 is similar to the restraining assembly 218.

In use, the restraining assembly 218 of the clamping device 206 shown in FIG. 11 is rotated by the handle 224 so that the handle 224 and the longitudinal axis of the stop plate 228 are generally parallel to the longitudinal axis of one of the respective rectangular openings 204. The stop plate 228 is then inserted through the opening 204 and the restraining assembly 218 is rotated by the handle 224 so that the longitudinal axis of the stop plate 228 is generally perpendicular to the longitudinal axis of the opening 204. The nut 230 is then rotated on the threaded shaft portion 222 so that an upper surface of the stop plate 228 abuts a lower surface of the support surface member 202. The restraining assembly 220 is operated in a similar manner. In this way, the restraining assemblies 218 and 220 removeably and adjustably secure the clamping device 206 to the support surface member 202.

If it is desired to reposition the clamping device 206 along the elongate axes of the slots 214 and 216, then the nut 230 of the restraining assembly 218 and a nut on the restraining assembly 220 are loosened. The clamping device 206 is then displaced along an axis defined by the slots 214 and 216 to the desired position. The restraining assemblies 218 and 220 are then operated as described above to removeably and adjustably secure the clamping device 206 to the support surface member 202.

Thus, where the treadway 200 includes rectangular openings 204 within the support surface member 202, the clamping device 206 of FIG. 11 still provides easy and quick adjustment of the device position on the treadway 200. Additionally, the clamping device 206 can be easily placed onto or removed from the support surface member 202 by aligning the stop plate 228 and a similar stop plate of the restraining assembly 220 with respective rectangular openings 204.

Figure 12:
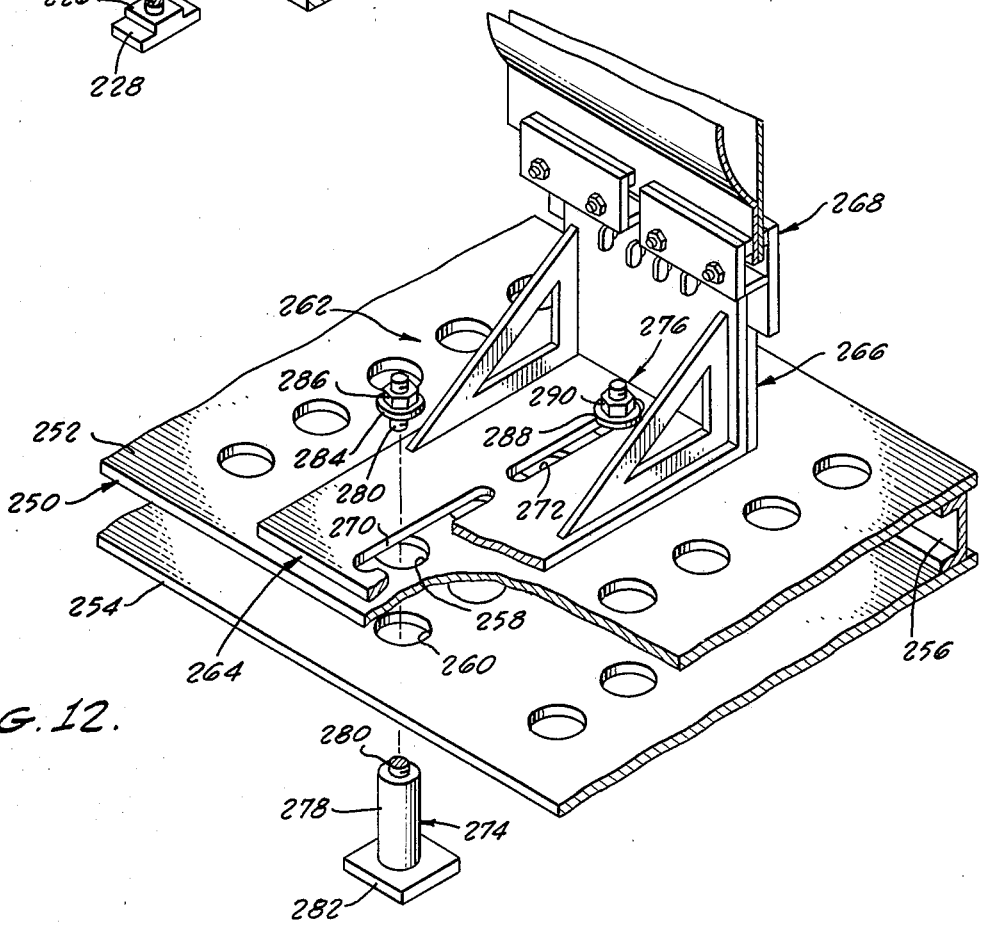
FIG. 12 shows a partially exploded perspective view of another version of a clamping device according to the present invention.

A third version of a clamping device according to the present invention is shown in FIG. 12. A treadway 250 of a vehicle frame straightening apparatus includes an upper support surface member 252 and a lower plate member 254. Suitable supports between the support surface member 252 and the lower plate member 254 can include U-channels 256 similar to the U-channels 24 described above with reference to FIG. 1. A plurality of concentric upper openings 258 and lower openings 260 are formed through the support surface member 252 and the lower plate member 254, respectively. The upper and lower openings 258 and 260 can have substantially the same diameter.

A clamping device 262 according to the present invention can be adapted for use with the treadway 250 of FIG. 12. The clamping device 262 includes an elongated, rectangular base plate 264, an attaching member 266 and a frame gripping means 268 similar to the base plate 208, the attaching member 210 and the frame gripping means 212 of the clamping device 206 described above with reference to FIG. 11.

The base plate 264 shown in FIG. 12 includes two elongated slots 270 and 272. The elongated slots 270 and 272 are similar to the elongated slots 214 and 216 described above and can be joined to form a single elongated slot.

The clamping device 262 includes a first and second restraint adapter 274 and 276 which adapt the device 262 for use with the treadway 250. The first adapter 274 includes a generally cylindrical body portion 278 that has a diameter slightly less than the diameters of the upper opening 258 and lower openings 260. A threaded shaft portion 280 is fixed at one end of the cylindrical body portion 278 and is coaxial therewith. A stop plate 282 is fixed to a second end of the cylindrical body portion 278. The stop plate 282 is perpendicular to the central axis of the cylindrical body portion 278 and threaded shaft portion 280 and the diagonal distance between opposite corners of the stop plate 282 is greater than the diameter of the lower openings 260. Thus, when the shaft portion 280 and the cylindrical body portion 278 are inserted upwardly through the lower and upper openings 260 and 258, an upper surface of the stop plate 282 abuts a lower surface of the lower plate member 254 to prevent further upward displacement of the first restraint adapter 274.

The second restraint adapter 276 is similar to the first restraint adapter 274.

To position the clamping device 262 upon the treadway 250 of FIG. 12, the base plate 264 of the clamping device 262 is placed against an upper surface of the support surface member 252. The threaded shaft portion 280 and the cylindrical portion 278 of the first restraint adapter 274 are passed upwardly through a respective pair of lower and upper openings 260 and 258 and the threaded shaft portion 280 is inserted through the elongated slot 270. A washer 284 is placed over the threaded shaft portion 280 and a nut 286 is threaded onto the shaft portion 280. The second restraint adapter 276 is similarly positioned through the elongated slot 272 and is secured by a washer 288 and a nut 290. The nuts 286 and 290 are then tightened to secure the base plate 264 and thus the clamping device 262 to the treadway 250. If adjustment of the clamping device 264 along the elongated slots 270 and 272 is desired, the nuts 286 and 290 can be loosened and the base plate 264 is then adjusted to the desired position. The clamping device 262 can be easily removed from the treadway 250 by simply removing the nuts 286 and 290.

Thus, the clamping device 262 of FIG. 12, as with the clamping devices 10 and 206 of FIGS. 1 and 11 respectively, can be positioned easily against or removed from the treadway 250 and can be easily adjusted along a first axis of the treadway 250 as defined by the elongated slots 270 and 272.

The first and second restraint adapters 274 and 276 can be adapted for use where the upper and lower openings 258 and 260 are not the same size or diameter. For example, if the lower openings 260 are larger than the upper openings 258, then the length of the cylindrical body portion 278 can be decreased. The upper surface of the stop plate 282 can then abut a lower surface of the support surface member 252 and the threaded shaft portion 280 can then extend from this shortened cylindrical body portion 278 through the elongated slot 270 as described above.

The clamping device 10 as shown in FIG. 13 can be used whenever it is desired to rigidly support a vehicle 9 with respect to the left and right treadways 11 and 12 of the frame straightening apparatus 8. Preferably, a plurality of the devices 10 are used to simultaneously support a vehicle frame with respect to the treadways 11 and 12. Similarly, the clamping devices 206 and 262 of FIGS. 11 and 12 can be used where a frame straightening apparatus includes the treadways 200 or 250 as described with reference to those Figures. When so used, the clamping devices 10, 206 and 262 position the vehicle frame within a reference plane against which the frame straightening forces can be accurately applied. Moreover, since the devices 10, 206 and 262 do not require repositioning or readjustment as frame straightening forces are applied from various angles with respect to the vehicle frame, vehicle frame straightening is more quickly and thus economically performed than with prior devices while providing precise frame straightening results.

The attaching member 30 can be rigidly affixed to one of the various frame gripping means described above. For example, the adapter member 170 of FIG. 9 can be rigidly secured through the attaching member 30 to the base plate 28 to provide a device 10 which can be removably secured to a specific portion of a vehicle frame.

While an exemplary embodiment of the invention has been described, it is to be understood that the invention is not limited to the details herein explained. It is expected that given the teachings herein, those skilled in the art will recognize numerous variations and equivalents which come within the spirit of the invention and which are intended to be included herein.

What is claimed is:

1. A device for securing a vehicle having a frame to a support surface of a vehicle frame straightening apparatus wherein the support surface includes an elongated opening therethrough having an elongate axis that defines a first axis of the support surface, the device comprising (a) a base plate comprising two holes therethrough;

(b) two restraining assemblies each rotatably carried within a respective hole for insertion through the elongated opening for securely holding the base plate against the support surface without rotation of the base plate;

(c) gripping means for removably gripping a portion of the vehicle frame;

(d) a receiving member affixed to the base plate and defining a receiving channel substantially perpendicular to the first axis for receiving the gripping means; and (e) securing means for removably securing the gripping means within the receiving channel so that the gripping means can be removably secured at a plurality of locations within the receiving channel for gripping different portions of the vehicle frame.

2. The device of claim 1 wherein the restraining assembly comprises (a) a shaft sized to fit through and rotate within the base plate hole and in the elongated opening, and (b) an elongated, rotatable restraining member depending from the shaft, the restraining member having a thickness less than the width of the elongated opening, and a length greater than the width of the elongated opening but less than the length of the elongated opening so that the restraining member can be inserted into the opening, the shaft being rotatable with respect to the base plate for rotating the restraining member to a first position generally parallel to the elongated opening elongate axis for inserting the restraining member through the elongated opening and for rotating the restraining member to a second position generally perpendicular to the elongated opening elongate axis, and (c) means for controllably urging the restraining and the base plate together to removably secure the support surface between the base plate and the restraining member when the restraining member is in the second position.

3. The device of claim 1 wherein the base plate further includes a keel member depending from the base plate to fit into the elongated opening when the base plate is positioned against the support surface for preventing the base plate from sliding in the elongated opening and to prevent rotation of the base plate.

4. A device for securing a vehicle having a frame to a support surface of a vehicle frame straightening apparatus, the support surface including an elongated opening therethrough having an elongate axis that defines a first axis of the support surface, the device comprising (a) a base plate having at least one hole therethrough;

(b) a restraining assembly rotatably carried within the hole for insertion through the support surface opening for securely holding the base plate against the support surface;

(c) an elongated keel depending from the base plate and sized for insertion into the elongated opening when the base plate is positioned against the support surface to prevent rotation of the base plate and to prevent the base plate from sliding in the elongated opening;

(d) gripping means for removably gripping a portion of the vehicle frame;

(e) a receiving member affixed to the base plate and defining a receiving channel substantially perpendicular to the first axis for receiving the gripping means; and (f) securing means for removably securing the gripping means within the receiving channel so that the gripping means can be removably secured at a plurality of locations within the receiving channel for gripping different portions of the vehicle frame.

5. The device of claims 1 or 4 wherein the gripping means further includes a plurality of openings, the receiving channel further includes opposing side walls, each sidewall having an opening coaxially aligned with the opening of the other sidewall, and the securing means includes a pin adapted to be removably received within the coaxially aligned openings and one of the gripping means openings when the gripping means is positioned within the receiving channel for adjustably securing the gripping means within the receiving channel.

6. The device of claims 1 or 4 wherein the vehicle includes a pinch weld and the frame gripping means includes clamping means for removably grasping a portion of the pinch weld.

7. The device of claims 1 or 4 wherein the vehicle includes an opening and the frame gripping means comprises a support member and a projecting member extending substantially perpendicularly therefrom adapted for insertion into the opening, the projecting member further including an offset portion adapted to extend through the frame opening for limiting the frame movement along an axis substantially perpendicular to the support member.

8. The device of claims 1 or 4 wherein the vehicle includes at least one fastener and the frame gripping means includes means for attaching to the fastener.

9. The device of claim 4 wherein each restraining assembly comprises (a) a shaft sized to fit through and rotate within one of the base plate holes and the elongated opening, (b) an elongated, rotatable restraining member depending from the shaft, the restraining member having a thickness less than the width of the elongated opening and a length greater than the width of the elongated opening but less than the length of the elongated opening so that the restraining member can be inserted into the elongated opening, the shaft being rotatable with respect to the base plate for rotating the restraining member to a first position generally parallel to the elongated opening elongate axis for inserting the restraining member through the elongated opening and for rotating the restraining member to a second position generally perpendicular to the elongated opening elongate axis, and (c) means for controllably urging the restraining member and the base plate together to removably secure the suppoort surface between the base plate and the restraining member when the restraining member is in the second position.

10. The device of claims 1, 4, 2, 3, or 9 wherein the base plate holes are elongated slots.

* * * * *